United States Patent [19]

Okoma et al.

[11] Patent Number: 4,850,830

[45] Date of Patent: Jul. 25, 1989

[54] LATERAL ROTARY COMPRESSOR HAVING VALVELESS LUBRICATING OIL PUMP MECHANISM

[75] Inventors: Kaoru Okoma, Fujinomiya; Takahiro Togawa, Numazu, both of Japan

[73] Assignee: Kabushiki Kaisha Toshiba, Kawasaki, Japan

[21] Appl. No.: 141,124

[22] Filed: Jan. 5, 1988

[30] Foreign Application Priority Data

Feb. 17, 1987 [JP] Japan ..... 62-32505

[51] Int. Cl.[4] ..... F04C 18/356; F04C 29/02; F15D 1/02

[52] U.S. Cl. ..... 418/63; 418/88; 418/94; 418/96; 138/37

[58] Field of Search ..... 418/63, 88, 94, 96; 417/76, 87; 138/37, 44; 137/803, 833

[56] References Cited

U.S. PATENT DOCUMENTS

| | | | |
|---|---|---|---|
| 2,018,341 | 10/1935 | Badger | 418/94 |
| 2,422,972 | 6/1947 | Knowles | 418/88 |
| 4,385,875 | 5/1983 | Kanazawa | 418/88 |
| 4,557,677 | 12/1985 | Hasegawa | 418/63 |

FOREIGN PATENT DOCUMENTS

| | | | |
|---|---|---|---|
| 511046 | 10/1930 | Fed. Rep. of Germany | 418/88 |
| 57176687 | 4/1956 | Japan . | |
| 61-14485 | 1/1986 | Japan . | |

*Primary Examiner*—John J. Vrablik

*Attorney, Agent, or Firm*—Cushman, Darby & Cushman

[57] ABSTRACT

A lateral rotary compressor includes a container for storing lubricating oil, compressing device disposed in the container for compressing a gaseous fluid, and a driving device disposed in the container for driving the compressing device. The compressing device includes a blade chamber defined in the compressing device above the surface level of the lubricating oil in the container, reciprocally movable blade disposed in the blade chamber for increasing and decreasing the volume in the blade chamber, and an oil passage device for drawing the lubricating oil in the container into the blade chamber and for feeding the lubricating oil in the blade chamber to the compressor device in response to the reciprocal movement of the blade.

8 Claims, 4 Drawing Sheets

FIG. 6
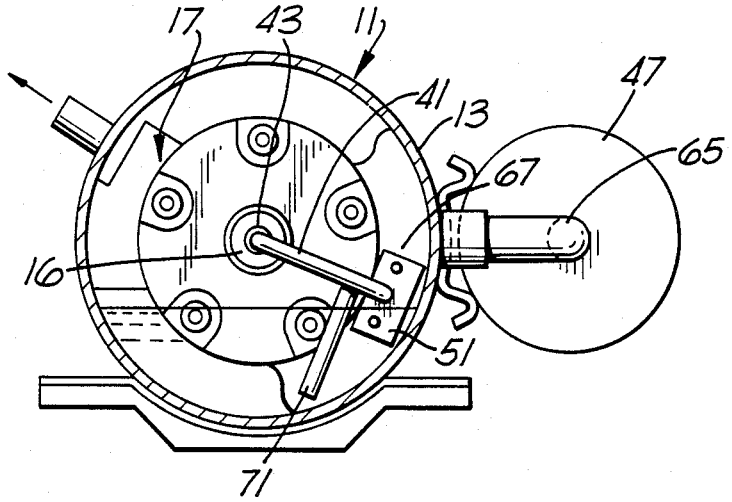
FIG. 7
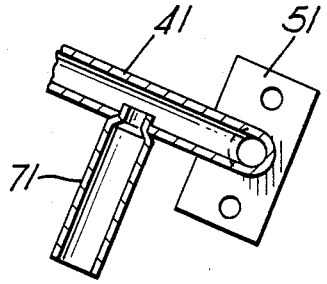
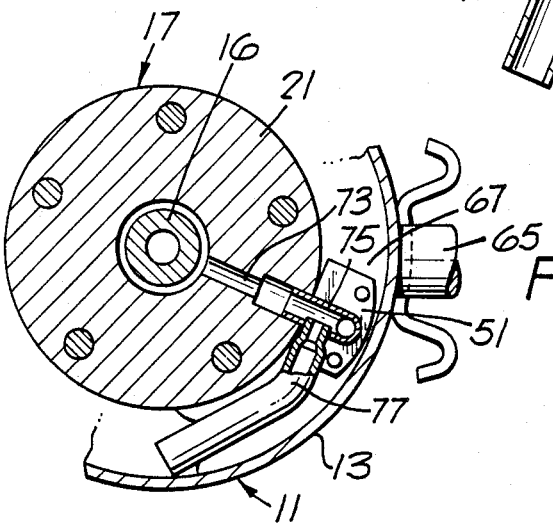
FIG. 8

LATERAL ROTARY COMPRESSOR HAVING VALVELESS LUBRICATING OIL PUMP MECHANISM

BACKGROUND OF THE INVENTION

1. Field of the invention

This invention relates, in general, to rotary compressors laterally installed in an apparatus, such as, e.g., air conditioners, refrigerators, etc., for compressing refrigerant in the refrigerating circuit of the apparatus. In particular, the invention relates to a rotary compressor provided with a lubricating oil pump mechanism for automatically feeding a lubricating oil to bearings of the compressor.

2. Description of the prior art

One example of a conventional rotary type compressor is disclosed in U.S. Pat. No. 4,557,677 issued to the same assignee as the present invention, and entitled VALVELESS LUBRICANT PUMP FOR A LATERAL ROTARY COMPRESSOR. FIG. 1 shows the prior art rotary compressor. A compressor 11 disposed in a hermetic container 13 typically includes a motor section 15 and a compressing section 17. Since compressor 11 is horizontally installed in an apparatus (not shown), motor section 15 is arranged on one side, and compressing section 17 is arranged on the other side of container 13 in the lateral direction.

Motor section 15 includes an annular stator 15*a* and a rotor 15*b* rotatably positioned inside stator 15*a*. Rotor 15*b* is provided with a lateral rotation shaft 16 for driving compressing section 17. Compressing section 17 is provided with a pair of bearings 19 and 21 for rotatably supporting lateral rotation shaft 16, and a cylinder 23 arranged therebetween. A compressing chamber 25 is established by the pair of bearings 19 and 21 and cylinder 23. Compressing chamber 25 is provided with a roller 27, which is secured to an eccentric portion 16*a* of rotation shaft 16. Therefore, roller 27 eccentrically rotates in compressing chamber 25 in response to the rotation of shaft 16. Cylinder 23 is provided with a blade 29, which is forcibly urged toward roller 27 by a spring 31 to reciprocate in the radius direction of compressing chamber 25. Blade 29 partitions compressing chamber 25 into a high pressure cell and a low pressure cell for compressing a gas fluid, e.g., refrigerant gas, fed to compressing chamber 25 through an intake pipe 33, shown in FIG. 2, in response to the eccentric rotation of shaft 16.

As shown in FIG. 1, an ordinarilly known oil pump mechanism 35 is provided in compressing section 17 for automatically feeding the lubricating oil stored in a bottom portion of container 13 to bearings 19 and 21 of compressing section 17 in response to the reciprocal movement of blade 29. The oil pump mechanism 35 includes a blade chamber 37 in the bottom portion of container 13. Blade chamber 37 is defined by cylinder 23 and each portion 39*a*, 39*b* individually extending from the pair of bearings 19 and 21. One end of an oil supply pipe 41 is in fluid communication with blade chamber 37, and the other end thereof is fluidly connected to an oil supply hole 43 of rotation shaft 16. A lubricating oil drawing hole 45 is provided on the lower portion of oil supply pipe 41 facing the bottom of container 13. Blade 29 reciprocates into blade chamber 37. In response to the reciprocal movement of blade 29, the lubricating oil in container 13 is periodically fed to bearings 19 and 21 through lubricating oil drawing hole 45, blade chamber 37 and oil supply pipe 41. In particular, when blade 29 moves toward rotation shaft 16, the lubricating oil in container 13 is drawn into blade chamber 37 through lubricating oil drawing hole 45 of oil supply pipe 41. When blade 29 moves in the centrifugal direction, the lubricating oil in blade chamber 37 is fed to oil supply hole 43 through oil supply pipe 41.

However, in the above-described prior art compressor, since blade chamber 37 is located at the bottom portion of container 13, the intake port (not shown) of compressing section 17 for drawing refrigerant has to be located essentially at the bottom portion of container 13. As a result, the installation height of the compressor assembly increases, as shown in FIG. 2, when intake pipe 33 from an accumulator 47 is connected to the intake port of the compressor. Furthermore, since a long intake pipe 33 is needed when accumulator 47 is attached to the side surface of container 13, such a long intake pipe may hinder the installation of environmental devices, such as a fan device, or other electrical component, close to the compressor, and may easily contact the environmental devices. The lubricating oil stored in container 13 maintains a prescribed level. Blade chamber 37 is disposed in a base portion 48. The relatively large volume of base portion 48 which is dipped in the lubricating oil causes a shortage of lubricating oil to the compressor.

SUMMARY OF THE INVENTION

Accordingly, it is an object of the present invention to reduce the installation height of a rotary compressor when the compressor is assembled in a refrigerating circuit.

It is another object of the present invention to store a suitable amount of lubricating oil in a rotary compressor.

It is still another object of the present invention to stably supply lubricating oil to the bearings of a rotary compressor.

To accomplish the above objects, there is provided a lateral rotary compressor comprising a hermetic container for storing a lubricating oil, and a compressing device disposed in the container for compressing a gaseous fluid. The compressing device includes a blade chamber defined in the compressing device above a prescribed surface level of the lubricating oil in the container, reciprocally movable blade disposed in the blade chamber for increasing and decreasing the volume in the blade chamber, and an oil passage section for drawing the lubricating oil in the container to the blade chamber, and for feeding the lubricating oil in the blade chamber to the compressing device in response to the reciprocal movement of the blade. The compressor further includes a driving device for driving the compressing device.

BRIEF DESCRIPTION OF THE DRAWINGS

These and other objects and advantages of this invention will become more apparent from the following detailed description of the presently preferred embodiment of the invention, taken in conjunction with the accompanying drawings of which:

FIG. 6 is a cross sectional front view illustrating a second embodiment of the present invention;

FIG. 7 is an enlarged view illustrating the connecting portion between an oil drawing pipe and an oil supply pipe shown in FIG. 6;

FIG. 8 is a cross sectional front view illustrating a third embodiment of the present invention;

DETAILED DESCRIPTION OF THE PREFERRED EMBODIMENT

Figure 1:
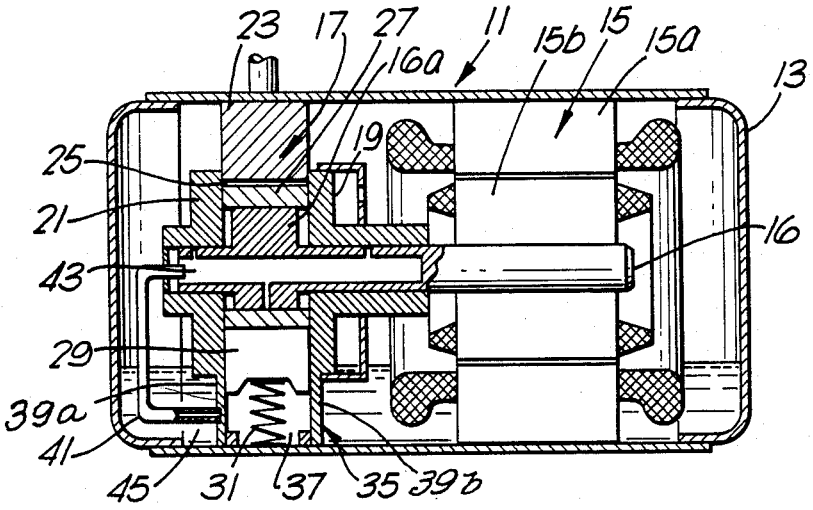
FIG. 1 PRIOR ART
FIG. 1 is a cross sectional side view illustrating one prior art compressor.
Figure 2:
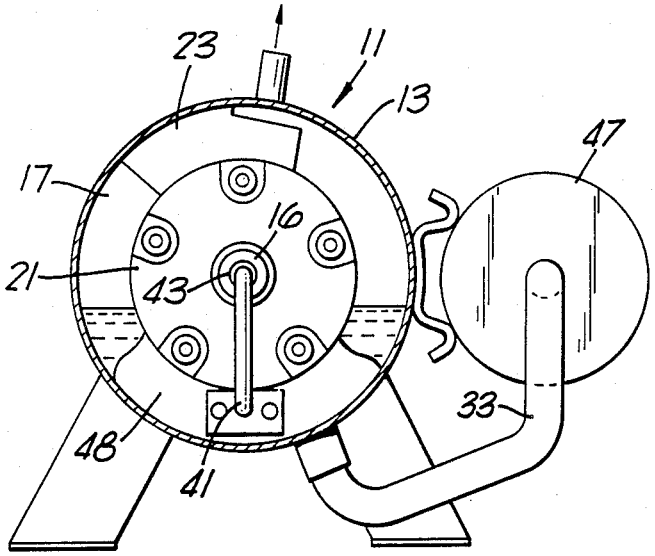
FIG. 2 PRIOR ART
FIG. 2 is a cross sectional front view illustrating the compressor, shown in FIG. 1, with an accumulator.

Preferred embodiments of the present invention will now be described in more detail with reference to the accompanying drawings. In the drawings, the same numerals are applied to the similar elements, and therefore, the descriptions thereof are not repeated.

Figure 3:
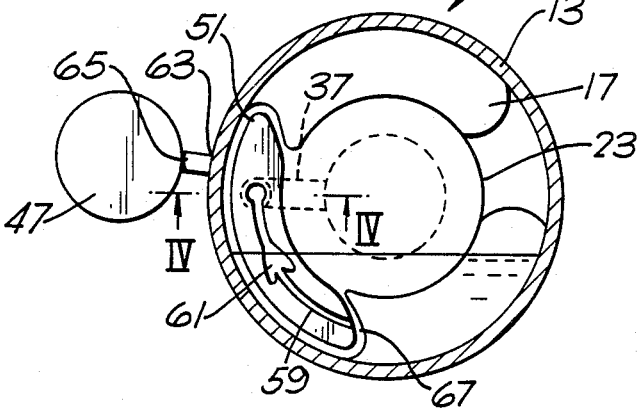
FIG. 3 is a cross sectional rear view illustrating a compressor of one embodiment of the present invention.
Figure 4:
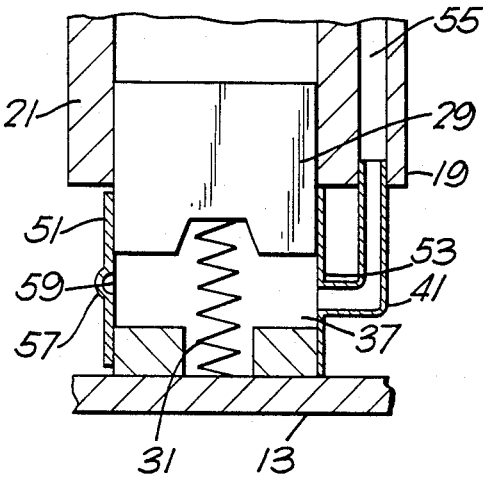
FIG. 4 is a cross sectional view taken on line IV—IV of FIG. 3.
Figure 5:
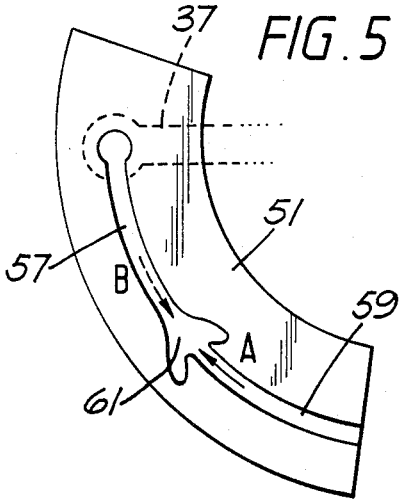
FIG. 5 is an enlarged view illustrating a side plate with an oil drawing path shown in FIG. 3.

One embodiment of the present invention will now be described hereafter. As shown in FIG. 3, blade chamber 37 is laterally disposed in container 13. Each side plate 51, 53 is respectively provided on the both sides of cylinder 23 for establishing blade chamber 37 after assembling blade 29 and spring 31 into cylinder 23, as shown in FIG. 4. One end of oil supply pipe 41 is fluidly connected to one of side plates 53, and the other end thereof is fluidly connected to an oil supply path 55 formed in one of bearings 19 for supplying the lubricating oil in blade chamber 37. A convex portion 57 is formed to the other side plate 51 such that it projects outward from the contacting surface between side plate 51 and cylinder 23. One end of convex portion 57 communicates with blade chamber 37 along the surface of cylinder 23. The other end of convex portion 57 extends along the surface of cylinder 23, and opens into the lubricating oil stored in container 13. Therefore, an oil drawing path 59 is defined by side plate 51 and cylinder 23, as shown in FIGS. 3 and 4. A liquid diode 61 acting as an one way valve is formed at the middle portion of oil drawing path 59. Liquid diode 61 allows the lubricating oil to flow from container 13 to blade chamber 37, as indicated by an arrow A in FIG. 5. On the contrary, liquid diode 61 prevents the lubricating oil from flowing from blade chamber 37 to container 13, as indicated by an arrow B. This is because the fluid resistance of liquid diode 61 in the direction of arrow B is greater than that in the direction of arrow A.

The lubricating oil supply operation will now be described. When compressor 11 is driven, blade 29 reciprocates along the radius direction of compressing chamber 25 in response to the eccentric rotation of roller 27, as stated before. When blade 29 moves from the outer-most position where spring 31 is compressed by roller 27 through blade 29 to the inner-most position where spring 31 is expanded, the pressure in blade chamber 37 decreases. Therefore, the lubricating oil in container 13 is drawn into blade chamber 37 through oil drawing path 59. At this time, liquid diode 61 of oil drawing path 59 allows the flow of the lubricating oil. When blade 29 moves from the inner-most position to the outer-most position, the pressure in blade chamber 37 increases. The lubricating oil in blade chamber 37 is discharged to both oil supply path 55 through oil supply pipe 41, and oil drawing path 59. As stated before, liquid diode 61 prevents the lubricating oil from flowing backward in oil drawing path 59. Therefore, almost all the lubricating oil discharged from blade chamber 37 is fed to oil supply path 55 through oil supply pipe 41. The above-described operation is repeated in response to the reciprocal movement of blade 29.

With the above-described embodiment, since the lubricating oil stored in the bottom portion of container 13 is drawn into blade chamber 37 through oil drawing path 59 in response to the reciprocal movement of blade 29, blade chamber 37 can be arranged laterally. Furthermore, since intake port 63 of compressing section 17 also is positioned laterally, the height of the compressor assembly can be reduced, as compared with the prior art. As shown in FIG. 3, a shorter intake pipe 65 can be used for connecting accumulator 47 and the intake port 63 of the compressor compared with the prior art when accumulator 47 is attached to the side wall of container 13. Thus, no contact occurs between such shorter intake pipe 65 and the environmental devices arranged close to compressor 11. Since only a part of base portion 67 in which blade chamber 37 is formed is dipped in the lubricating oil stored in container 13, a large amount of the lubricating oil can be stored in container 13. Furthermore, since oil drawing path 59 is formed between convex portion 57 of side plate 51 and the surface of cylinder 23, oil drawing path 59 may be easily formed by forming a steel plate with a press, sintering a plastic material, or molding a plastic material.

A second embodiment of the present invention will now be described. As shown in FIG. 6, the blade chamber (not shown) of compressing section 17 is located above the surface level of the lubricating oil stored in container 13. Oil supply pipe 41 is fluidly connected between the blade chamber and oil supply hole 43 of rotation shaft 16. One end of a connecting pipe 71 projects into oil supply pipe 41, and the other end thereof extends into the lubricating oil stored in container 13. Connecting pipe 71 acts as an oil drawing path. As shown in FIG. 7, the diameter of one end of connecting pipe 71 is smaller than that of other portion of connecting pipe 71 for easy connection between connecting pipe 71 and oil supply pipe 41, and for improvement of oil supply character.

With this embodiment, the lubricating oil stored in container 13 is drawn into the blade chamber through connecting pipe 71 and oil supply pipe 41, and then the lubricating oil in the blade chamber is supplied to oil supply hole 43 of rotation shaft 16 in response to the reciprocal movement of the blade, as stated before. At this time, the lubricating oil from the blade chamber does not return to connecting pipe 71 because of the projection end of connecting pipe 71. The above-described second embodiment has advantages similar to that of the first embodiment.

A third embodiment of the present invention will now be described. As shown in FIG. 8, an oil supply path 73 is formed in bearing 21. One end of oil supply path 73 opens to the rotation gap between bearing 21 and rotation shaft 16, and the other end thereof is in fluid communication with an oil supply pipe 75. Oil supply pipe 75 is in fluid communication with the blade chamber. One end of a connecting pipe 77 is in fluid communication with oil supply pipe 75, and the other end thereof extends into the lubricating oil stored in container 13. Connecting pipe 77 acts as an oil drawing path. The diameter of one end of connecting pipe 77 is smaller than that of the other portions thereof. In this embodiment, the lubricating oil stored in container 13 is drawn into the blade chamber through connecting pipe 77 and oil supply pipe 75, and then the lubricating oil in the blade chamber is supplied to the rotation gap between bearing 21 and rotation shaft 16 in response to the reciprocal movement of the blade, as stated above. The above-described third embodiment also has advantages similar to those of the first and the second embodiments.

Figure 9:
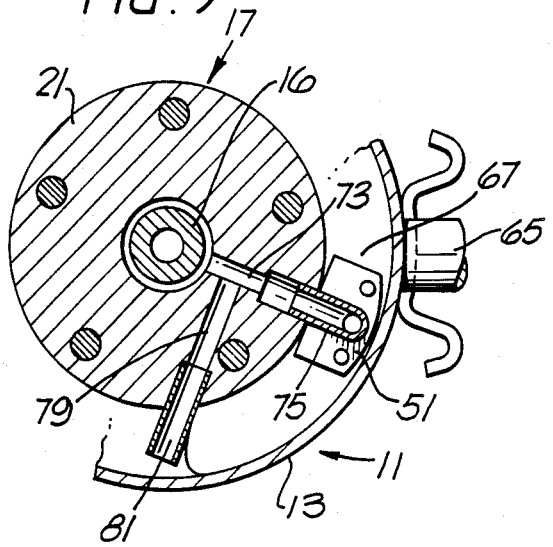
FIG. 9 is a cross sectional front view illustrating a fourth embodiment of the present invention.

A fourth embodiment of the present invention will now be described. As shown in FIG. 9, an oil drawing path 79 is formed in bearing 21. One end of oil drawing path 79 is in fluid communication with oil supply path 73, and the other end thereof is in fluid communication with an oil drawing pipe 81. Oil drawing pipe 81 extends into the lubricating oil stored in container 11. In this embodiment, the lubricating oil stored in container 13 is drawn into the blade chamber through oil drawing pipe 81, oil drawing path 79, oil supply path 73 and oil supply pipe 75, and then the lubricating oil in the blade chamber is supplied to the rotation gap between bearing 21 and rotation shaft 16 in response to the reciprocal movement of the blade. As stated above, the fourth embodiment has advantages similar to those of the first, the second and the third embodiments.

Figure 10:
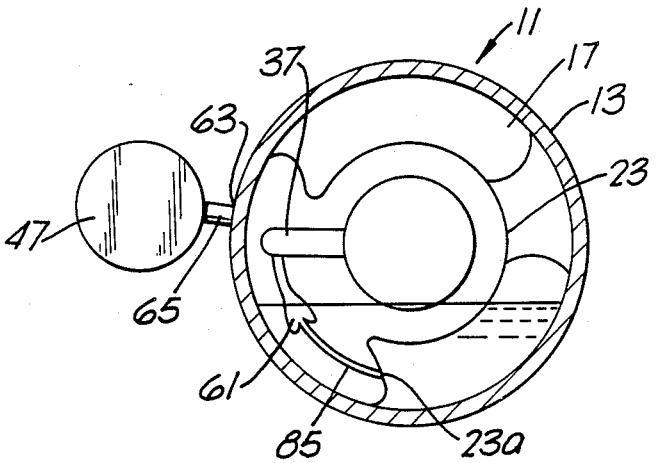
FIG. 10 is a cross sectional rear view illustrating a compressor with no side plate of a fifth embodiment of the present invention.

A fifth embodiment of the present invention will now be described with reference to FIG. 10. In this embodiment, a groove 85 acting as an oil drawing path is provided in the surface of cylinder 23. One end of groove 85 is fluidly connected to blade chamber 37, and the other end thereof extends to the end portion 23*a* of cylinder 23. Liquid diode 61 also is formed in the middle portion of groove 85. Therefore, the oil drawing path is established between cylinder 23 and the other side plate 51 when the other side plate 51 is attached to the surface of cylinder 23.

In this embodiment, no extra element is needed to form an oil drawing path. Also, the oil drawing path can be easily established only by assembling the side plate 51 to the surface of cylinder 23.

The present invention has been described with respect to specific embodiments. However, other embodiments based on the principles of the present invention should be obvious to those of ordinary skill in the art. Such embodiments are intended to be covered by the claims.

What is claimed is:

1. A lateral rotary compressor comprising:

container means for storing lubricating oil, the lubricating oil having a prescribed surface level; and compressing means for compressing a gaseous fluid, including:

a cylinder having a wall, a blade chamber defined in the compressing means above the surface level of the lubricating oil, the blade chamber having a variable volume and at least one side wall, reciprocally movable blade means disposed in the blade chamber for varying the volume in the blade chamber, and oil passage means including an oil drawing path means defined between the wall of the cylinder and the side wall of the blade chamber for drawing the lubricating oil in the container into the blade chamber, and an oil supply path means for supplying the lubricating oil in the blade chamber to the compressing means in response to the reciprocal movement of the blade means.

2. A compressor according to claim 1, wherein the cylinder is disposed substantially horizontally in the container.

3. A compressor according to claim 2, also including driving means for driving the compressing means, the driving means including rotation shaft means extending substantially horizontally through the cylinder for transmitting rotational force.

4. A compressor according to claim 3, wherein the rotation shaft means includes offset means responsive to the rotation shaft means for reciprocally moving the blade means.

5. A compressor according to claim 3, wherein the compressing means includes bearing means for rotatably supporting the rotation shaft means.

6. A compressor according to claim 3, wherein the blade means includes a blade and a sprint urging the blade toward the rotation shaft means. .

7. A compressor according to claim 6, wherein the at least one side wall of the blade chamber includes a pair of plates disposed opposite to one another, one of the plate pair including a groove portion, the oil drawing path means being defined between the wall of the cylinder and the groove portion for drawing the lubricating oil in the container into the blade chamber, and an oil supply path means being connected between the other plate and the bearing means for supplying the lubricating oil in the blade chamber to the bearing means.

8. A compressor according to claim 7, wherein the oil drawing path means includes liquid diode means for restraining the lubricating oil in the blade chamber from adverse flowing.

* * * * *